US007543903B2

(12) United States Patent
Little

(10) Patent No.: US 7,543,903 B2
(45) Date of Patent: Jun. 9, 2009

(54) IMAGE-FORMING DEVICE DIAGNOSIS

(75) Inventor: Robert F. Little, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 745 days.

(21) Appl. No.: 10/854,403

(22) Filed: May 26, 2004

(65) Prior Publication Data

US 2005/0264596 A1 Dec. 1, 2005

(51) Int. Cl.
*B41J 29/393* (2006.01)
*B41J 29/38* (2006.01)

(52) U.S. Cl. ..... 347/19; 347/9

(58) Field of Classification Search ..... 347/19, 347/9

See application file for complete search history.

(56) References Cited

U.S. PATENT DOCUMENTS

| | | | | |
|---|---|---|---|---|
| 5,128,691 | A | 7/1992 | Millet et al. | |
| 5,369,420 | A | 11/1994 | Bartky | |
| 5,835,108 | A | 11/1998 | Beauchamp et al. | |
| 5,856,836 | A | 1/1999 | Silverbrook | |
| 5,898,443 | A * | 4/1999 | Yoshino et al. | 347/19 |
| 6,076,915 | A | 6/2000 | Gast et al. | |
| 6,164,745 | A | 12/2000 | Nagoshi et al. | |
| 6,310,637 | B1 | 10/2001 | Shimada et al. | |
| 6,450,613 | B1 | 9/2002 | Rietbergen | |
| 6,454,383 | B2 * | 9/2002 | Lund et al. | 347/19 |
| 6,464,321 | B1 * | 10/2002 | Nunokawa | 347/19 |
| 6,502,920 | B1 | 1/2003 | Anderson et al. | |
| 6,517,180 | B2 | 2/2003 | Tullis et al. | |
| 6,530,645 | B2 | 3/2003 | Haflinger | |
| 6,554,390 | B2 | 4/2003 | Arquilevich et al. | |
| 6,607,261 | B1 | 8/2003 | Shimada | |
| 6,623,096 | B1 | 9/2003 | Castano et al. | |
| 6,631,971 | B2 | 10/2003 | Adkins et al. | |
| 2002/0126169 | A1 * | 9/2002 | Wyngaert et al. | 347/40 |
| 2003/0007024 | A1 * | 1/2003 | Fujimori | 347/15 |
| 2003/0189617 | A1 * | 10/2003 | Mott et al. | 347/41 |
| 2004/0169697 | A1 * | 9/2004 | Silverbrook | 347/40 |
| 2004/0252152 | A1 * | 12/2004 | Vilanova et al. | 347/19 |
| 2005/0179736 | A1 * | 8/2005 | Mataki | 347/54 |
| 2005/0237351 | A1 * | 10/2005 | Heiles et al. | 347/9 |

* cited by examiner

*Primary Examiner*—Matthew Luu
*Assistant Examiner*—Jannelle M Lebron

(57) ABSTRACT

A method for diagnosing image-forming devices includes forming a non-diagnostic image on a surface, forming diagnostic marks on the surface using distinct image-forming points and sensing the diagnostic marks.

23 Claims, 8 Drawing Sheets

IMAGE-FORMING DEVICE DIAGNOSIS

BACKGROUND

Image-forming devices, such as printers, are commonly used in a wide variety of applications such as the printing of text upon sheets of print media, the printing of labels on three-dimensional objects or the printing of photos or other images upon sheet media or upon objects. Misaligned or malfunctioning image-forming points or other device components may result in impaired print quality. Unfortunately, in some applications, diagnosing such misalignments or malfunctions has been generally time consuming and unreliable.

DETAILED DESCRIPTION OF THE EXAMPLE EMBODIMENTS

Figure 1:
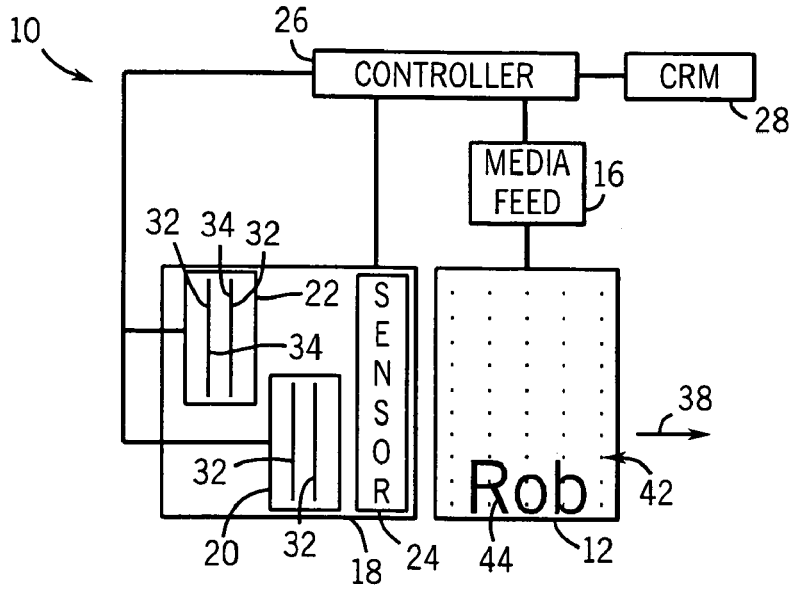
FIG. 1 is a schematic illustration of one example of an image-forming device.

FIG. 1 is a schematic illustration of one example of an image-forming device 10 configured to form images upon a medium 12. In one embodiment, images may be formed by depositing material, such as ink, upon medium 12. In other embodiments, images may be formed upon medium 12 by heating or otherwise interacting with medium 12. As will be described in greater detail hereafter, device 10 is further configured to diagnose errors during the formation of images upon medium 12.

Device 10 generally includes media feed 16, support 18, printheads 20, 22, sensor 24, controller 26 and computer, or processor, readable medium 28. Media feed 16, schematically shown, comprises one or more mechanisms such as belts, pulleys, drive rollers and motors, configured to feed and move medium 12 relative to printheads 20, 22 and sensor 24. The exact configuration of media feed 16 may be varied depending upon the characteristics of medium 12 being fed past printheads 20, 22 and sensor 24. For example, media feed 16 may have different configurations depending upon the particular dimensions of medium 12.

Support 18 generally comprises one or more structures configured to support printheads 20, 22 and sensor 24 relative to medium 12. In one particular embodiment, support 18 is specifically configured to allow printheads 20, 22 to be repositioned and stationarily supported at different positions relative to medium 12 and at different positions relative to one another. In other embodiments, support 18 may not provide for adjustable positioning of printheads 20, 22. Although device 10 is illustrated as supporting printheads 20, 22 and sensor 24 with a single support 18, device 10 may alternatively include multiple supports 18 which individually support printheads 20, 22 and sensor 24.

Printheads 20, 22 comprise individual structures providing image-forming points 32. In particular embodiment shown, image-forming points are illustrated as being arranged in columns 34. In other embodiments, image-forming points 32 may be arranged in various other fashions. For purposes of this disclosure, the term "image-forming points" shall mean any distinct point that causes an image to be formed upon a medium. In one embodiment, image-forming points 32 include a plurality of individual nozzles configured to dispense fluid ink or other fluid printing material upon a medium. In one embodiment, printheads 20 and 22 are coupled to one or more ink cartridges containing one or more differently colored inks or other printing materials, wherein the ink supply is provided in the cartridge itself. In another embodiment, printheads 20, 22 may be supplied with ink or printing material from a fluid delivery system exterior to support 18.

Although device 10 is illustrated as including two printheads 20, 22, device 10 may alternatively include a single printhead or a greater number of such printheads. Furthermore, although printheads 20, 22 are described as having image-forming points 32 comprising fluid ejecting nozzles, image-forming points 32 may alternatively comprise heating elements that vary in temperature such as those used in thermal wax printing, dye-sublimation printing or thermal autochrome printing.

Sensor 24 comprises a mechanism configured to detect images formed upon medium 12 by image-forming points 32. Sensor 24 generates electrical signals which are transmitted to and processed by controller 26. In one embodiment, sensor 24 comprises an optical sensor.

Controller 26 generally comprises a processor unit configured to generate control signals which are transmitted to media feed 16, printheads 20, 22 and sensor 24. Controller 26 may comprise a processing unit that executes sequences of instructions contained in a memory (not shown). Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hardwired circuitry may be used in place of or in combination with software instructions to implement the functions described. Controller 26 is not limited to any specific combination of hardware circuitry and software, nor to any particular source for the instructions executed by the processing unit. Although controller 26 is illustrated as being physically incorporated as part of device 10, controller 26 may alternatively be physically incorporated as part of another device such as a distinct computing device to which device 10 is connected. In other embodiments, portions of controller 26 may be physically incorporated into distinct electronic devices, wherein such portions cooperate with one another. For example, a first portion of controller 26 may be located in device 10 while a second portion of controller 26 is incorporated as part of a distinct computer.

Controller 26 receives data representing an image to be printed from a media reader, a computer, or directly from memory of a device, such as video camera, digital camera, scanner and the like. Controller 26 further receives information from sensors (not shown) indicating the characteristics and locations of printheads 20, 22. Based upon such information, controller 26 controls media feed 16 to move medium 12 in the direction indicated by arrow 38 and controls the formation of images upon medium 12 by image-forming points 32.

Computer readable media 28 generally comprises any suitable form of media containing executable instructions that are readable by a computing device. Examples of computer readable media containing executable instructions that are readable by a computing device include: optical disks, magnetic disks or tape, and digital memory hardwired circuitry. The instructions contained by medium 28 are used by controller 26 to generate control signals to diagnose any errors or potential problems being experienced by device 10. In particular, the instructions contained on media 28 direct controller 26 to generate control signals that cause image-forming points 32 to form diagnostic marks 42 upon print medium 12 while also forming non-diagnostic image 44 upon medium 12.

For purposes of this disclosure, the term "diagnostic marks" refers to those marks formed upon medium 12 that are configured so as to not convey any particular message or concept to an individual viewing the printed upon medium 12, but are solely used by device 10 for diagnostic purposes. For example, in one embodiment, diagnostic marks 42 may be configured to be substantially imperceptible and not noticeable to a human eye at a normal viewing distance. Diagnostic marks 42 formed upon medium 12 correspond to individual image-forming points 32 and are formed upon medium 12 such that sensor 24 may detect and distinguish individual marks 42 from one another so as to correlate individual marks 42 to individual image-forming points 32.

In contrast, non-diagnostic image 44 is configured to visually communicate to an individual. Non-diagnostic image 44 may comprise a photo, a drawing, a design, a series of alphanumeric symbols and the like. Non-diagnostic image 44 is generally formed by multiple marks formed by multiple image-forming points 32 which are extremely closely spaced to one another or which are overlapping one another (i.e., half-toning).

Computer readable medium 28 further contains instructions for causing controller 26 to generate control signals which direct sensor 24 to sense and detect the presence or omission of individual marks 42 as well as the relative spacing between marks 42. This information detected by sensor 24 is transmitted back to controller 26, wherein controller 26 diagnoses the accuracy and performance of device 10 based upon such information.

Figure 2:
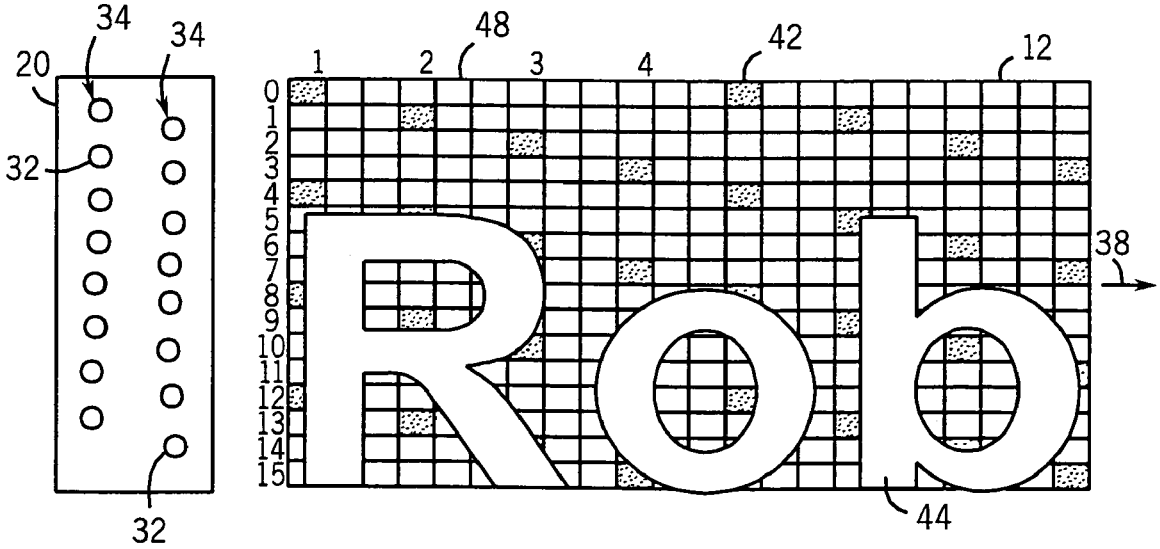
FIG. 2 is a schematic illustration of one example of a printhead having image-forming points and a medium having a non-diagnostic image and diagnostic marks.

FIG. 2 schematically illustrates one example of diagnostic marks 42 formed relative to a non-diagnostic image 44 upon a print medium 12 by printhead 20 having two columns 34 of image-forming points 32. In the particular example illustrated, image-forming points 32 of the two columns 34 are staggered, effectively doubling the resolution of printhead 20. In other embodiments, columns 34 may be aligned. For purposes of illustration only, FIG. 2 further includes a reference grid 48 to assist in identifying locations of diagnostic marks 42. The grid 48 is not printed on the medium 12. Those cells of grid 48 which are filled represent the relative location of marks 42 (sometimes referred to as "pixels"). As shown by FIG. 2, medium 12 is moved by media feed 16 (shown in FIG. 1) relative to printhead 20 in the direction indicated by arrow 38. As medium 12 is moved, controller 26 generates control signals which cause image-forming points 32 to be selectively actuated to form diagnostic marks 42 and non-diagnostic image 44 upon medium 12. Diagnostic marks 42 are formed about and are superimposed on image 44. Those marks 42 that are superimposed upon image 44 are not evaluated in device 10 (shown in FIG. 1).

Diagnostic marks 42 are generally configured so as to be imperceptible or not noticeable to an individual viewing non-diagnostic image 44 from a distance of at least about 7 inches. In one embodiment, each diagnostic mark 42 has a diameter of no greater than 200 microns. In one specific embodiment, each mark 42 has a diameter of no greater than 50 microns. The spacing between diagnostic marks 42 generally falls within a lower range of densities having a minimum value enabling sensor 24 (shown in FIG. 1) to simultaneously detect at least two consecutive marks 42 in a direction parallel to arrow 38 and to also simultaneously detect at least two marks 42 in a direction perpendicular to the medium feed direction as indicated by arrow 38. The spacing between diagnostic marks 42 generally also falls within an upper range of densities having a maximum value such that marks 42 are not noticeable or such that the background colors for image 44 are not distorted or changed. In other embodiments however, the individual size or density of marks 42 may be enlarged where the noticeability of marks 42 is less important or where the background pattern does not substantially interfere with the readability/viewing of the non-diagnostic image. In one particular embodiment, the density of marks 42 is approximately 0.1%. Each individual mark 42 is formed upon medium 12 with a color or darkness chosen so as to sufficiently contrast with the surrounding surface of medium 12 for being detected by sensor 24. For example, marks 42 may be formed using a black ink deposited upon a white medium. In other embodiments, marks 42 may be formed with a colored ink deposited upon a white medium 12 or a colored medium 12. For example, a sufficiently large density of black marks 42 may result in a generally white background for image 44 appearing more gray.

Figure 3:
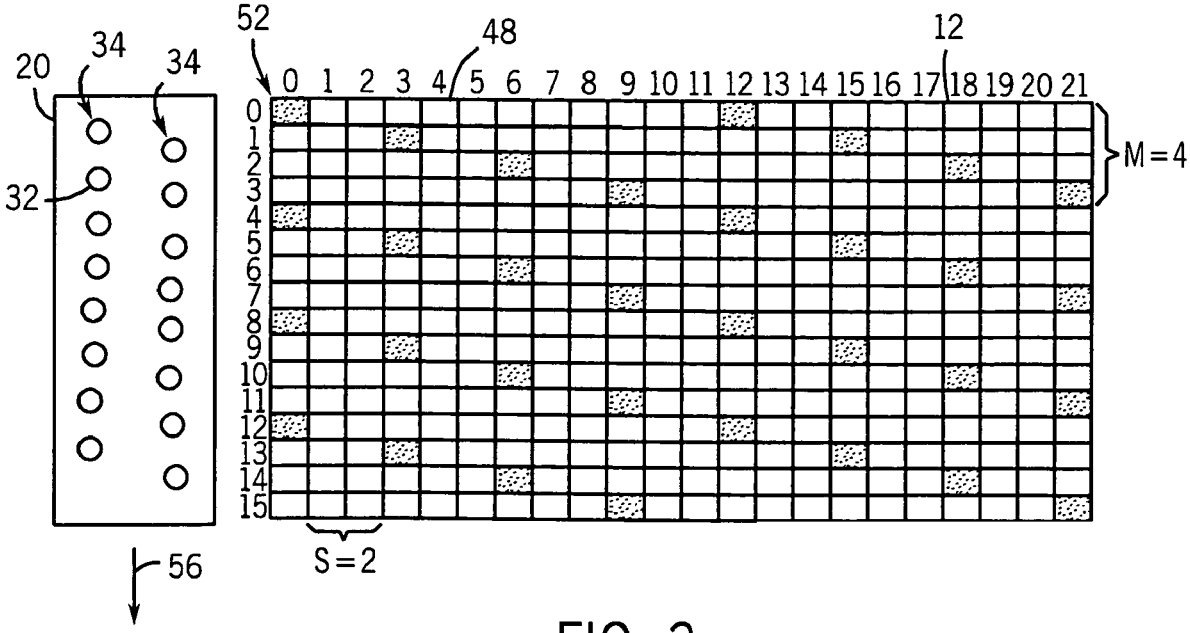
FIG. 3 is a schematic illustration of a first pattern of the diagnostic marks of FIG. 2 and the printhead of FIG. 2 according to an exemplary embodiment.

According to one embodiment, diagnostic marks 42 are formed upon medium 12 with a constant and predefined frequency or pattern. FIG. 3 schematically illustrates a pattern 52 of marks 42 upon medium 12 (omitting image 44). Once again, FIG. 3 is provided with a reference grid 48 for the sole purpose of illustrating pattern 52. In addition, FIG. 3 schematically illustrates printhead 20. Although printhead 20 is schematically illustrated as having two columns 34 of eight image-forming points 32, printhead 20 may alternatively have a greater or fewer number of such image-forming points 32, a greater or fewer number of columns 34 and a greater or fewer number of image-forming points 32 per column 34. For example, in one embodiment, printhead 20 includes two columns 34, wherein each column includes approximately 250 image-forming points 32. Although image forming points 32 of the two columns 34 are staggered in the direction indicated by arrow 56, points 32 may alternately be aligned.

In the particular example shown in FIG. 3, pattern 52 has a formula C=(s+1)*(MOD(r, m)+m*n), where:

C is the column in which a mark 42 should be formed for a particular row r of image-forming points starting at row 0;

m=the number of unmarked rows between marks 42 in each column plus one;

n=the nth diagnostic mark 42 in a row for a particular image-forming point 32, where n begins with 0; and s=the designated spacing between columns of marks 42.

Figure 4:
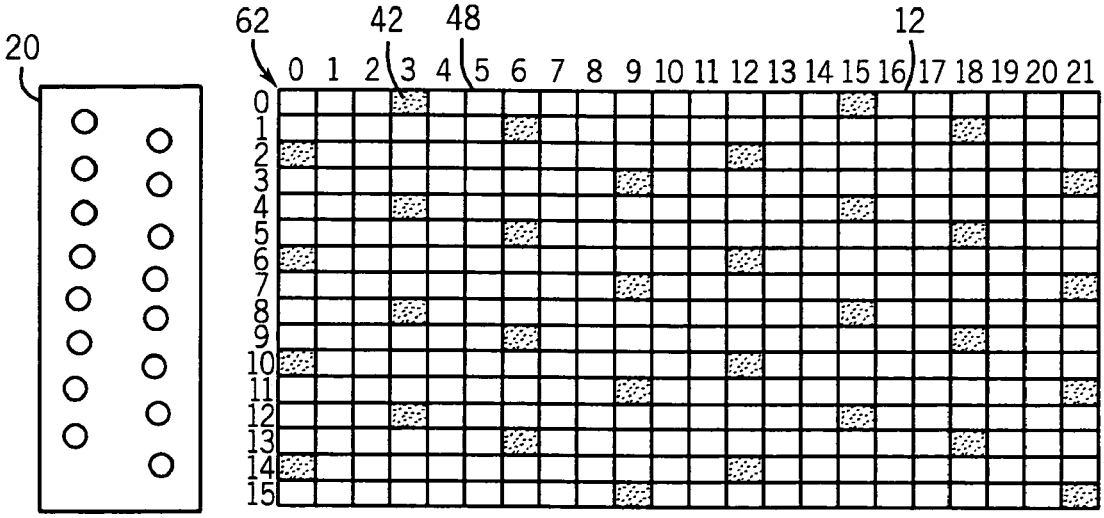
FIG. 4 is a schematic illustration of a second pattern of the diagnostic marks of FIG. 2 and the printhead of FIG. 2.

In the particular example shown in FIG. 3, printhead 20 is illustrated as having 16 rows of image-forming points 32, causing n to range from 0 to 15. The value m is designated to be 4 and the value s is designated to be 2. The function MOD (number, divisor) returns a remainder after the number is divided by the divisor. One example of an application of the formula would be for image-forming point 32 in row 1, wherein 3*(MOD(1, 4)+4*n) equals 3 for n=0 and 15 for n=1. As a result, as shown in FIG. 3, image-forming points in row 1 may be actuated to form diagnostic marks 42 in the third column and in the fifteenth column. The formula is similarly applied to image-forming points 32 for row 0 and rows 2-15 of printhead 20. As shown by FIG. 4, pattern 52 repeats itself beginning at column 12.

Because diagnostic marks 42 are printed upon medium 12 in a pattern that is repeated, marks 42 are uniformly spaced, preventing the accumulation of marks 42 in any one particular spot which would increase the noticeability of marks 42. At the same time, each of the image-forming points 32 may be selectively actuated for individual diagnosis and refreshment of infrequently used image-forming points 32. With the particular diagnostic pattern shown in FIG. 3, the nozzles are activated at a frequency of at least $$\frac{1}{m(s+1)}$$

whether or not they are used in the non-diagnostic image 44 (shown in FIG. 1) so that they are both refreshed and available for diagnosis.

FIG. 4 schematically illustrates pattern 62 of image-forming points 42 upon medium 12 (omitting image 44 for purposes of illustration) printed by printhead 20. FIG. 4 additionally includes a reference grid 48 for the sole purpose of illustrating the relative positions of marks 42. As compared to pattern 52, pattern 62 has a higher entropy. Higher entropy is achieved by randomizing or interchanging the order of the columns having marks 42 from pattern 52 in FIG. 3. Because pattern 62 has a higher entropy, pattern 62 and its marks 42 may be less noticeable to individuals. Controller 26 (shown in FIG. 1) corrects or rearranges the order of the columns when diagnosing issues based upon the positioning and spacing of marks 42. Because pattern 62 has a higher entropy, greater computer processing is generally employed to diagnose errors using marks 42. In other embodiments, other patterns for marks 42 may be employed. For example, in another embodiment, column spacings may be varied or randomized.

Figure 5:
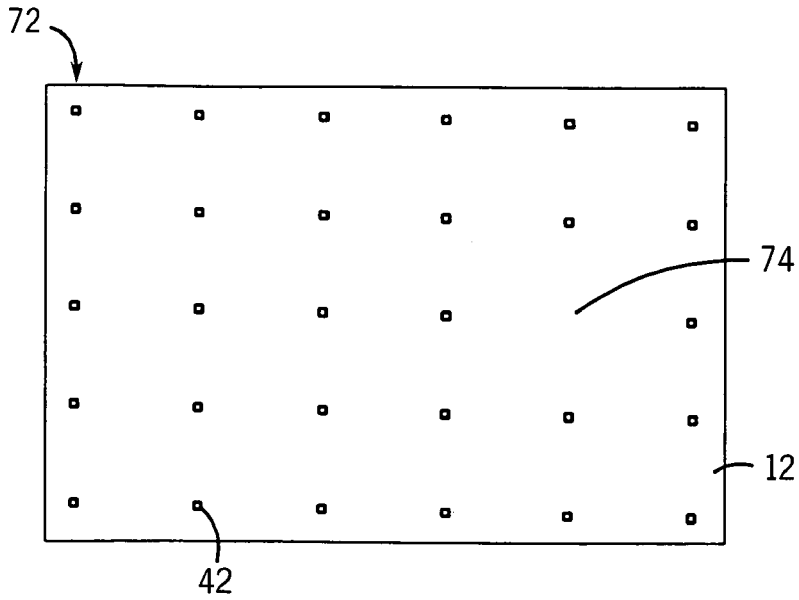
FIG. 5 is a schematic illustration of a pattern of diagnostic marks formed upon a medium having a missing mark due to a malfunctioning image-forming point.

FIGS. 5-9 illustrate examples of various diagnostic information that may be derived from diagnostic marks 42 by sensor 24 and controller 26. FIG. 5 illustrates an example of a pattern 72 of diagnostic marks 42 formed upon medium 12. Pattern 72 is configured such that each mark 42 corresponds to one of a set of image-forming points 32. Pattern 72 is scanned by sensor 24 with the sensed information being transmitted to controller 26 (shown in FIG. 1). Controller 26 identifies holes in pattern 72. Holes constitute spaces where a mark would normally be formed but for a malfunctioning printhead. For example, FIG. 5 illustrates a hole 74 where a mark 42 would normally be located according to pattern 72. Controller 26 then identifies the specific image-forming point 32 which would have been responsible for forming mark 42 within hole 74. This image-forming point 32 is further identified as malfunctioning. As a result, controller 26 may take corrective measures by notifying an individual that a particular image-forming point 32 is malfunctioning and/or by generating a service station call (i.e., executing a printhead service maintenance procedure), by implementing a spitting operation upon completion of a print job and/or by generating control signals to selectively actuate other image-forming points 32 in lieu of a malfunctioning image-forming point 32 when subsequently forming a non-diagnostic image.

Figure 6:
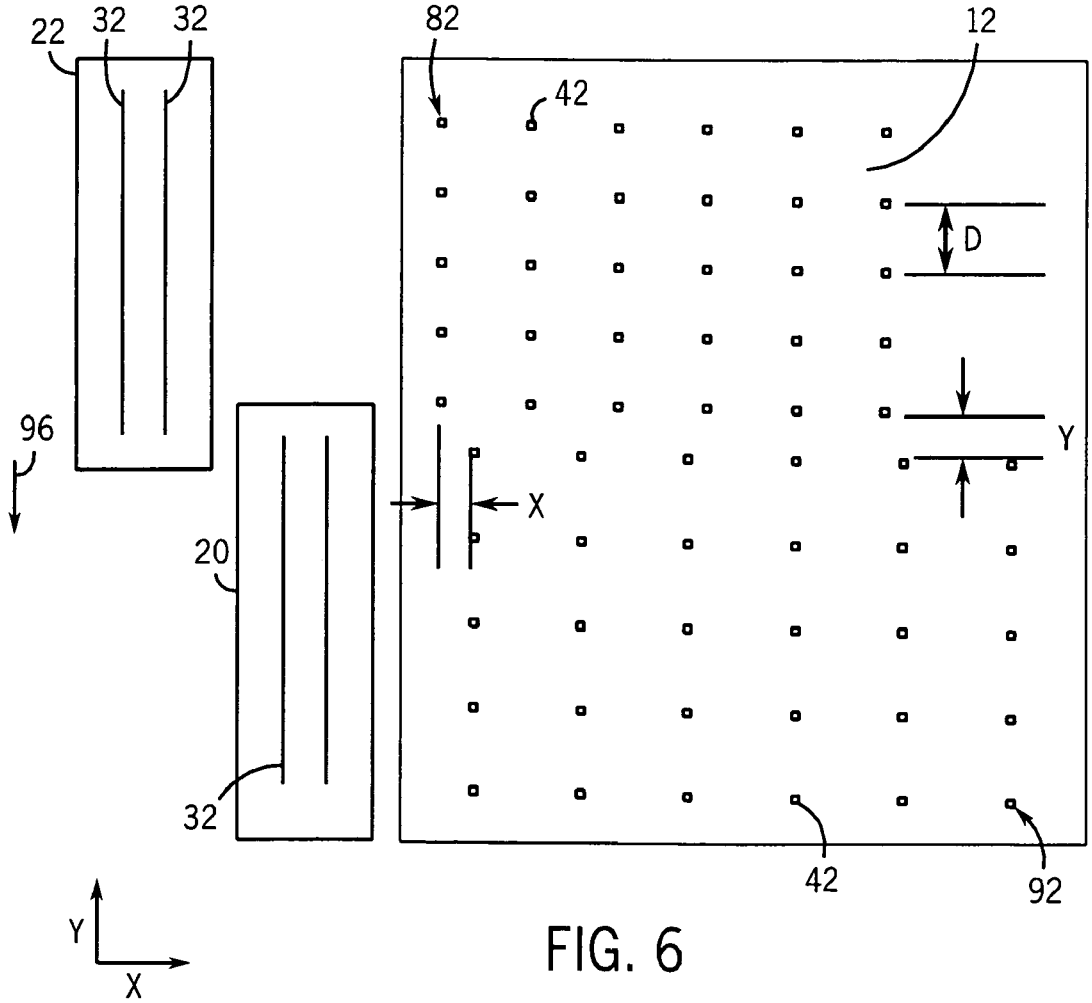
FIG. 6 is a schematic illustration of a first pattern of diagnostic marks formed upon a medium by a first printhead and a second pattern of diagnostic marks formed upon the medium by a second printhead.

FIG. 6 schematically illustrates the diagnosis of pen alignment offsets utilizing diagnostic marks 42. In particular, FIG. 6 illustrates a pattern 82 of marks 42 utilizing image-forming points 32 of printhead 22 upon medium 12 and the forming of a second pattern 92 of diagnostic marks 42 utilizing image-forming points 32 of printhead 20. Sensor 24 scans patterns 82 and 92 and transmits sensed information to controller 26 (shown in FIG. 1). Controller 26 calculates either or both of an x-axis offset between patterns 82 and 92 and a y-axis offset between patterns 82 and 92. The x-axis offset is equal to the actual distance between marks 42 of pattern 82 and corresponding marks 42 of pattern 92 as compared to a nominal or intended x-axis spacing between such marks. In the particular example shown, marks 42 of pattern 82 are intended to be in horizontal alignment with corresponding marks 42 of pattern 92. However, as shown by FIG. 6, pattern 92 is offset to the right from pattern 82 by a distance X. As a result of this diagnosed misalignment, controller 26 may take remedial actions such as notifying an individual of the misalignment between printheads 22 and 20, and/or generating control signals to adjust the timing at which image-forming points 32 of printhead 22 are actuated as compared to image-forming points 32 of printhead 20. For example, controller 26 may generate control signals that cause particular image-forming points 32 of printhead 20 to be actuated earlier in time to compensate for offset distance X during the subsequent printing of a non-diagnostic image 44. In other embodiments, controller 26 may generate control signals causing an actuator (such as a hydraulic actuator, a pneumatic actuator, an electric solenoid, a voice coil or the like) to physically move and adjust the positioning of either printhead 22 or printhead 20 relative to one another to compensate for offset distance X.

Based upon the information received from sensor 24, controller 26 further identifies a y-axis offset between patterns 82 and 92. The y-axis offset is equal to a difference between the actual spacing between patterns 82 and 92 and an intended or nominal spacing in between patterns 82 and 92. In the particular example shown in FIG. 6, printheads 20 and 22 are configured such that the intended spacing between patterns 82 and 92 is substantially equal to the spacing between consecutive marks 42 in pattern 82 or in pattern 92 (distance D). However, in the examples shown in FIG. 6, patterns 82 and 92 are actually spaced from one another by a distance Y. The distance D-Y represents the y-axis offset distance. Controller 26 (shown in FIG. 1) may take remedial action based upon the diagnosed y-axis offset D-Y by notifying an individual of the diagnosed offset error and/or by generating control signals to adjust which image-forming points 32 are actuated during the subsequent forming of a non-diagnostic image 44. For example, during the subsequent printing of a non-diagnostic image 44, controller 26 may actuate an alternative image-forming point 32 in lieu of an image-forming point 32 that would otherwise be utilized in subsequently forming a non-diagnostic image 44, wherein the alternative image-forming point 32 is spaced from the original image-forming point 32 in the direction indicated by arrow 96 by a distance D-Y. In other embodiments, controller 26 may generate control signals which cause an actuator, such as a hydraulic actuator, pneumatic actuator, electrical actuator, voice coil or the like, to physically move printhead 20 relative to printhead 22 in a negative y-axis direction or move printhead 22 relative to printhead 20 in a positive y-axis direction.

Figure 7:
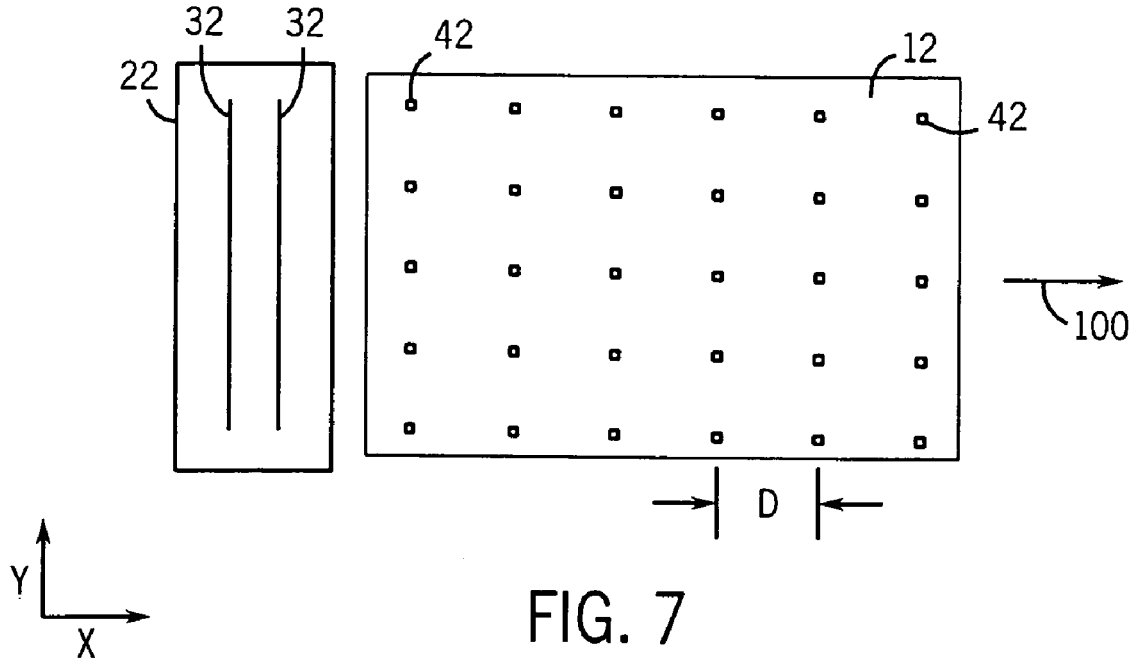
FIG. 7 is a schematic illustration of diagnostic marks formed upon a medium by a printhead.

FIG. 7 schematically illustrates the use of diagnostic marks 42 to diagnose errors in the movement or feeding of media 12 relative to printhead 22. As shown by FIG. 7, controller 26 (shown in FIG. 1) generates control signals causing media feed 16 to move medium 12 relative to printhead 22 in the direction indicated by arrow 100. As medium 12 is moved, controller 26 generates control signals further causing printhead 22 to form diagnostic marks 42 along with images 44 (shown in FIG. 2) with image-forming points 32. Diagnostic marks 42 are formed on medium 12 at a fixed time interval. Sensor 24 senses the spacing or distance D between consecutive or non-consecutive marks 42. Based upon this sensed distance D, controller 26 calculates the actual speed at which medium 12 is being fed relative to printhead 22 by media feed 16 by dividing distance D by the fixed time interval between the two spaced marks 42. According to another method, diagnostic marks may be formed at a fixed nominal distance interval by media feed 16. Sensor 24 senses the spacing or distance D between consecutive or non-consecutive marks. Based upon this sensed distance D, controller 26 calculates the speed at which medium 12 is being fed relative to printhead 22 by media feed 16 by dividing the actual distance D by the expected or nominal distance and multiplying the value by the expected or nominal velocity or speed which medium 12 is supposed to be moved relative to printhead 22 by media feed 16

$$\left(\text{i.e., } V_{actual} = \frac{d_{actual}}{d_{ideal}} \cdot V_{ideal}\right).$$

As a result, controller 26 may calculate the actual speed at which medium 12 is being moved and may adjust the operation of media feed 16 accordingly. In addition, controller 26 may evaluate the uniformity of spacing between marks 42 to identify non-uniform movement (e.g., jitter) of medium 12 caused by speed variation. In response to actual media movement speed varying from an intended medium movement speed, controller 26 may take remedial action by notifying an individual of such issues, or by correcting the operation of media feed 16.

Figure 8:
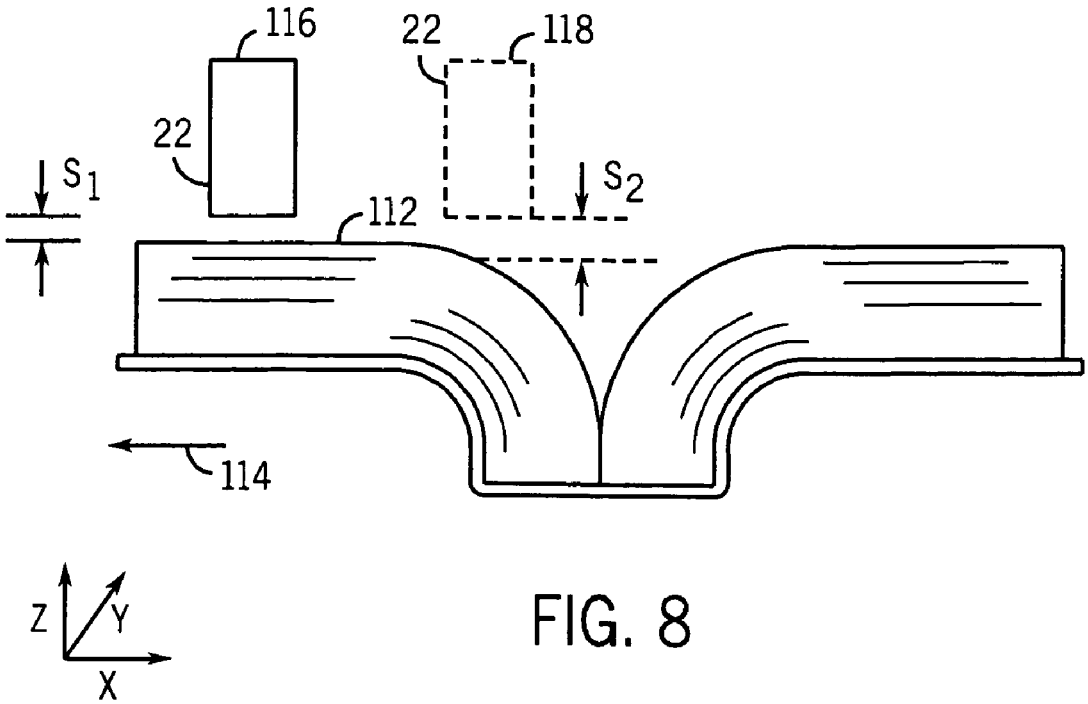
FIG. 8 is a side elevational view schematically illustrating a medium being advanced relative to a printhead.
Figure 9:
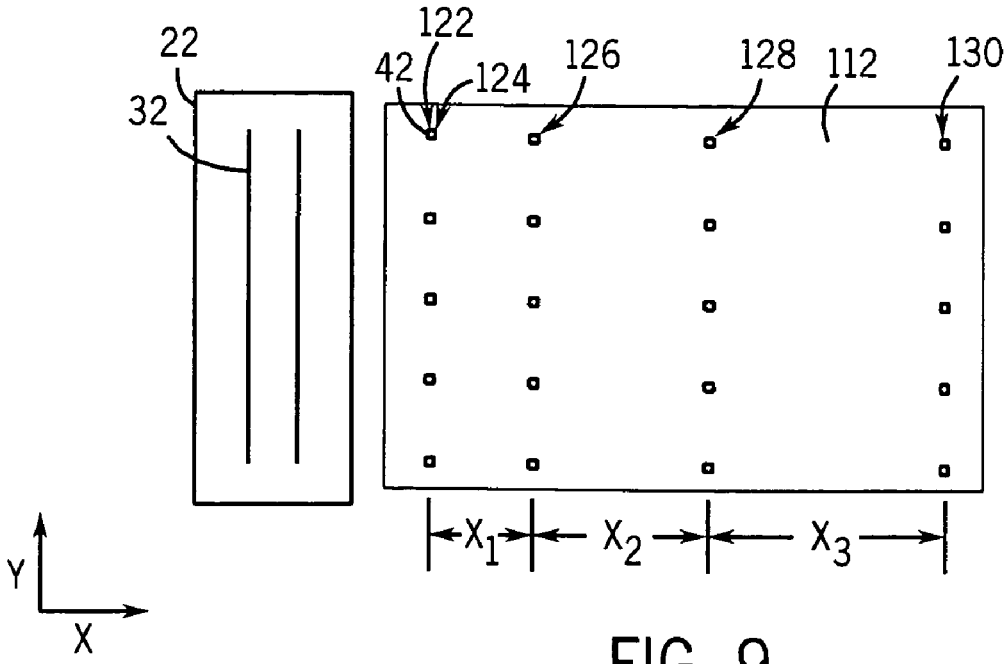
FIG. 9 is a schematic illustration of a pattern of diagnostic marks formed upon a non-flat medium by a printhead.

FIGS. 8 and 9 schematically illustrate the use of diagnostic marks 42 by device 10 to diagnose and identify curvature of medium 12. In particular, FIG. 8 illustrates one example of a curved or non-flat surface of a medium 112 upon which non-diagnostic images 44 (shown in FIG. 2) and diagnostic marks 42 (shown in FIG. 9) are formed using printhead 22. Although medium 112 is illustrated as a curved surface of a page of a spined book, pamphlet, magazine or the like, medium 112 may alternatively comprise a curved surface of any article or object upon which non-diagnostic images 44, such as bar codes and the like, are to be formed. Due to its non-flat surface, portions of medium 112 that are spaced from one another along the x-axis will be differently spaced from printhead 22 along the Z-axis. For example, printhead 22 is spaced from medium 112 by a first spacing $S_1$ at the position 116 relative to medium 112 (shown in solid lines) and is spaced from medium 112 by a second greater spacing $S_2$ at the position 118 relative to medium 112 (shown in phantom). As a result, ink or other printing material from image-forming points 32 will have a greater flight time in traversing spacing $S_2$. Because medium 112 is generally moved relative to printhead 22 in the direction indicated by arrow 114, diagnostic marks 42 formed by image-forming points 32 while printhead 22 is at the first position 116 have smaller spacings as compared to diagnostic marks 42 formed by printhead 22 while printhead 22 is at the second position 118.

FIG. 9 schematically illustrates a pattern 122 of diagnostic marks 42 formed upon medium 112 by image-forming points 32 of printhead 22 during a print job in which image 44 (shown in FIG. 2) is also formed. As shown by FIG. 9, pattern 122 includes four columns 124, 126, 128 and 130 of diagnostic marks 42. Columns 124 and 126 of marks 42 are formed upon a generally flat portion of medium 112. As a result, columns 124 and 126 are spaced from one another in the x-axis by a nominal or nominal spacing $X_1$. However, medium 112 is generally non-flat or arcuate to the right of column 126. As a result, ink or other printing material ejected from printhead 22 has a longer flight path and is spaced from the preceding column by an increased distance greater than the nominal spacing. In the particular example shown, column 128 of marks 42 is spaced from column 126 by distance $X_2$ which is greater than distance $X_1$. Likewise, column 130 is spaced from column 128 by a distance $X_3$ which is greater than $X_2$. Sensor 24 (shown in FIG. 1) senses the spacing between columns 124, 126 and 128 and transmits such information to controller 126. Controller 126 compares each of distances $X_1$, $X_2$ and $X_3$ with the nominal spacing to calculate the distance at which columns 128 and 130 are offset and to further calculate a compensation distance. In the particular example shown, column 128 has an offset distance of $X_2-X_1$ in a positive direction along axis x. Column 130 has an offset value of $(X_3-X_1)+(X_2-X_1)$. Based on such offset distances, controller 26 generates control signals which cause media feed 16 to move media 112 relative to printhead 22 at speeds during subsequent printing of non-diagnostic images 44 so as to compensate for the offset distances. For example, in one embodiment, controller 26 may generate control signals causing media feed 16 to move medium 112 at a slower velocity relative to printhead 22 during the subsequent printing of non-diagnostic images 44 upon those portions of medium 44 which are curved as indicated by the greater spacing between columns 126 and 128 and between columns 128 and 130. In other embodiments, controller 26 may alternatively generate control signals which cause the actuation of image-forming points 32 earlier in time during the subsequent formation of non-diagnostic images 44 on curved portions of medium 112.

Although FIGS. 8 and 9 illustrate the detection and compensation for a non-flat surface which is convex only in the x-axis direction, diagnostic marks 42 may also be formed upon a medium 112 which is concave in the x-axis direction or upon a medium 112 which is convex or concave in both the x-axis direction and the y-axis direction. In those applications wherein medium 112 is non-flat in the y-axis direction, sensor 24 senses the varying spacing between rows of diagnostic marks 42 (extending perpendicular to columns 124, 126, 128 and 130) to identify the general curvature of medium 112 in the y-axis direction and to compensate for such curvature by using alternative image-forming points 32 which are spaced from those image-forming points 32 which would otherwise be used but for the offset in the y-axis direction.

Overall, some embodiments of the diagnostic methods performed by image-forming device 10 may provide one or more of the following several advantages. First, the diagnostic methods may be performed during a normal print job in which non-diagnostic images 44 are being formed upon a medium. As a result, print jobs are not interrupted. Moreover, the status or health of image-forming points and the alignment of printheads may be measured at almost anytime or at regular intervals during a print job. Because diagnostic marks are generally not noticeable upon medium 112, diagnostic marks 42 do not impair the use of the medium containing non-diagnostic images. At the same time, diagnostic images 42 have sufficient contrast so as to be read by sensor 24 for faster, automatic and more reliable inspection of diagnostic marks 42.

Second, because each of the image-forming points 32 are generally used to form the pattern of diagnostic marks 42, unused or infrequently used image-forming points are refreshed. For example, in those embodiments in which image-forming points comprise fluid ejecting nozzles, the formation of the diagnostic marks using such infrequently used nozzles keeps such nozzles healthy. In some embodiments, fewer than all of the points 32 are used.

Third, the diagnostic methods simultaneously identify multiple issues that may occur in an image-forming device. In addition to identifying malfunctioning image-forming points, the diagnostic methods also identify misalignment between printheads. The diagnostic methods also identify issues regarding the movement of a medium with respect to the image-forming points. For example, the diagnostic methods may be used to evaluate the speed at which media feed 16 is moving a medium relative to the printheads, to evaluate and identify jittering or other non-uniform movement of the medium, to identify slip or skew of the medium and to identify media feed encoder eccentricity.

Fourth, the diagnostic method enables the evaluation of non-flat printing surfaces. As a result, the diagnostic methods used by image-forming device 10 enable image-forming device 10 to more accurately and reliably print non-diagnostic images 44 upon non-flat surfaces which may be convex or concave in multiple directions.

Each of the aforementioned advantageous features of image-forming device 10 and the diagnostic methods performed by image-forming device 10 may be used independent of one another and may be incorporated into other image-forming devices or printing systems. For example, the formation of image-forming points 42 upon a medium may be used by an image-forming device for evaluating or diagnosing fewer than all of the issues described above. In other embodiments, the use of diagnostic marks 42, which are formed upon a medium in real time during printing of one or more non-diagnostic images, may be used to diagnose other identified issues or potential problems associated with a particular image-forming device.

Figure 10:
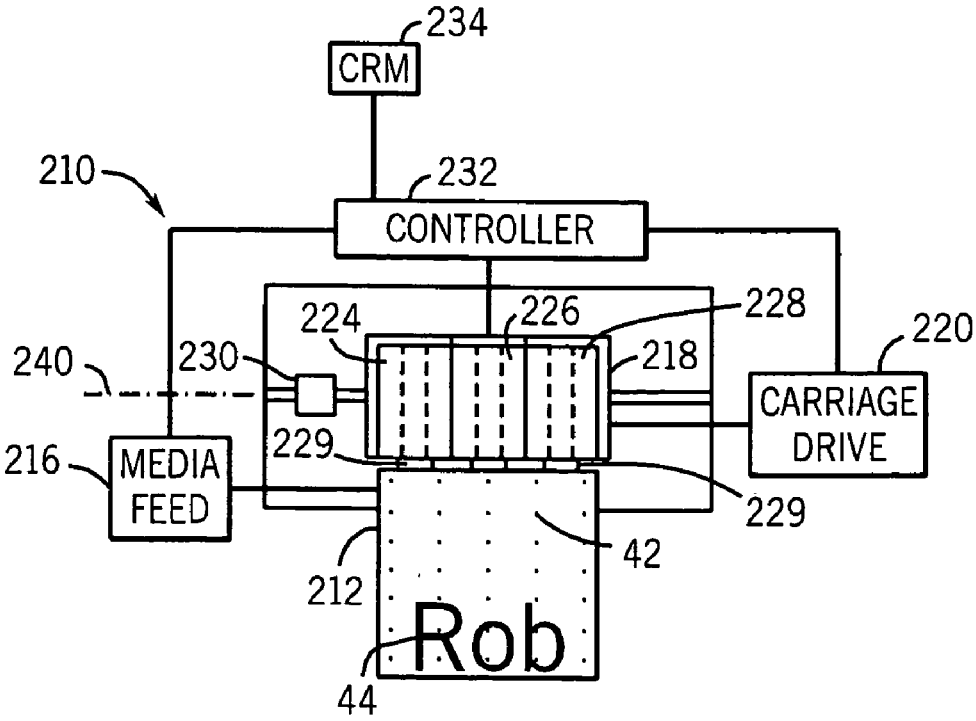
FIG. 10 is a schematic illustration of another embodiment of the image-forming device of FIG. 1.
Figure 11A:
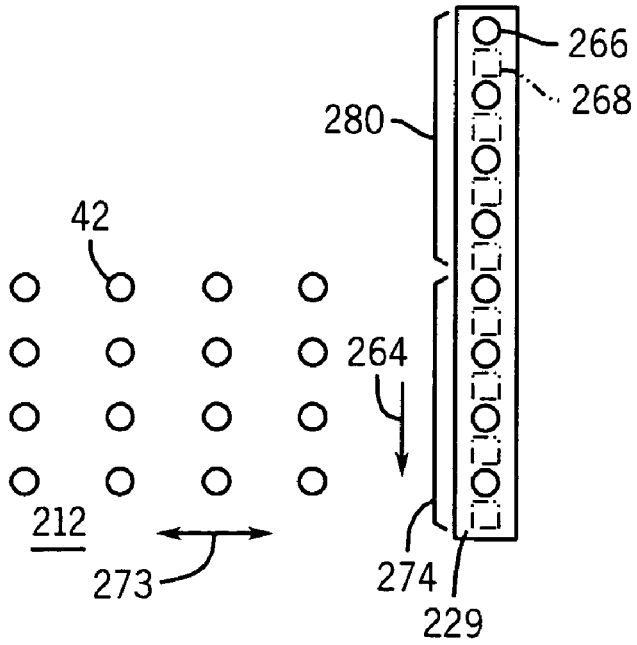
FIG. 11A is a schematic illustration of the first pattern of diagnostic marks formed upon a medium during a first pass of a printhead.
Figure 11B:
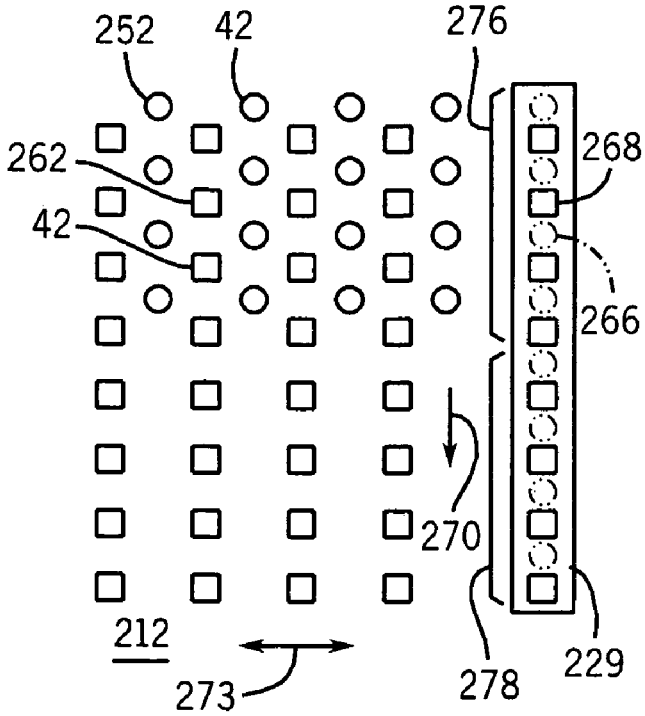
FIG. 11B is a schematic illustration of a second pattern of diagnostic marks formed upon the medium by the printhead during a second pass.
Figure 11C:
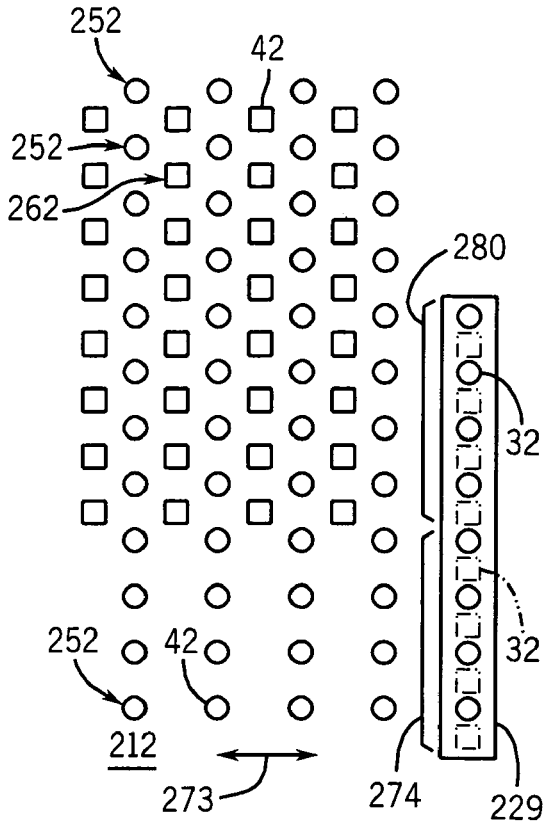
FIG. 11C is a schematic illustration of the first pattern of diagnostic marks formed upon the medium by the printhead during a third pass.
Figure 11D:
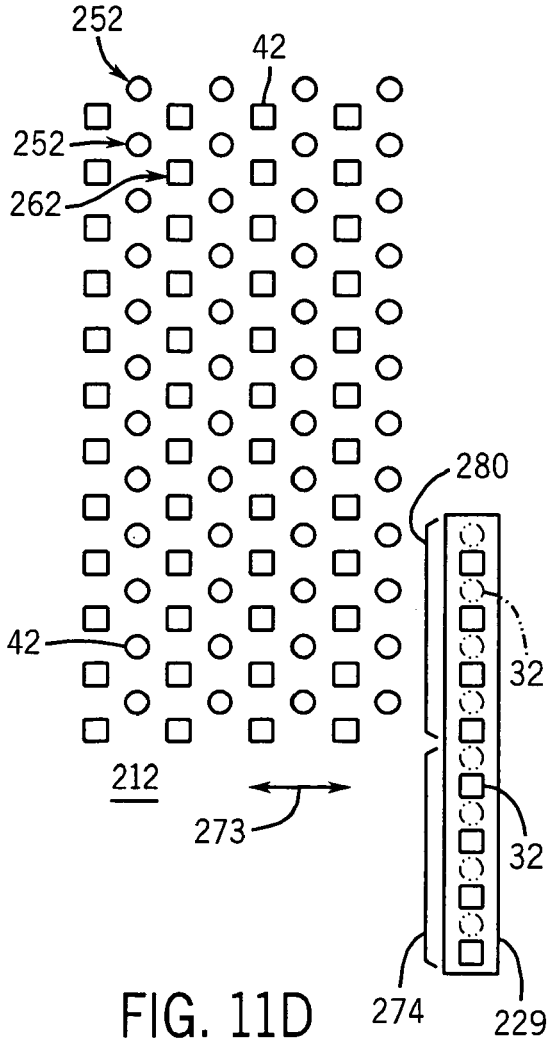
FIG. 11D is a schematic illustration of the second pattern of diagnostic marks formed upon the medium during a last pass of the printhead.
Figure 11E:
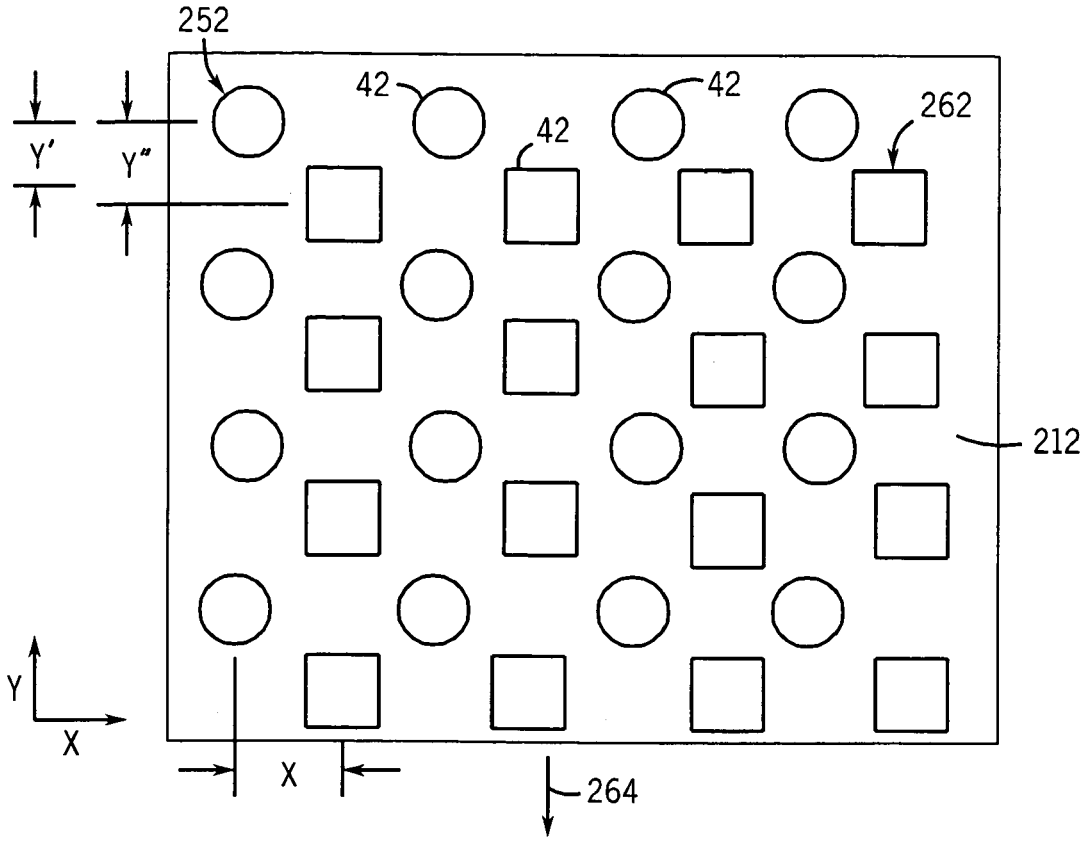
FIG. 11E is a top plan view of an interleaved portion of the first pattern and the second pattern of diagnostic marks formed upon the medium by the printhead.
Figure 12:
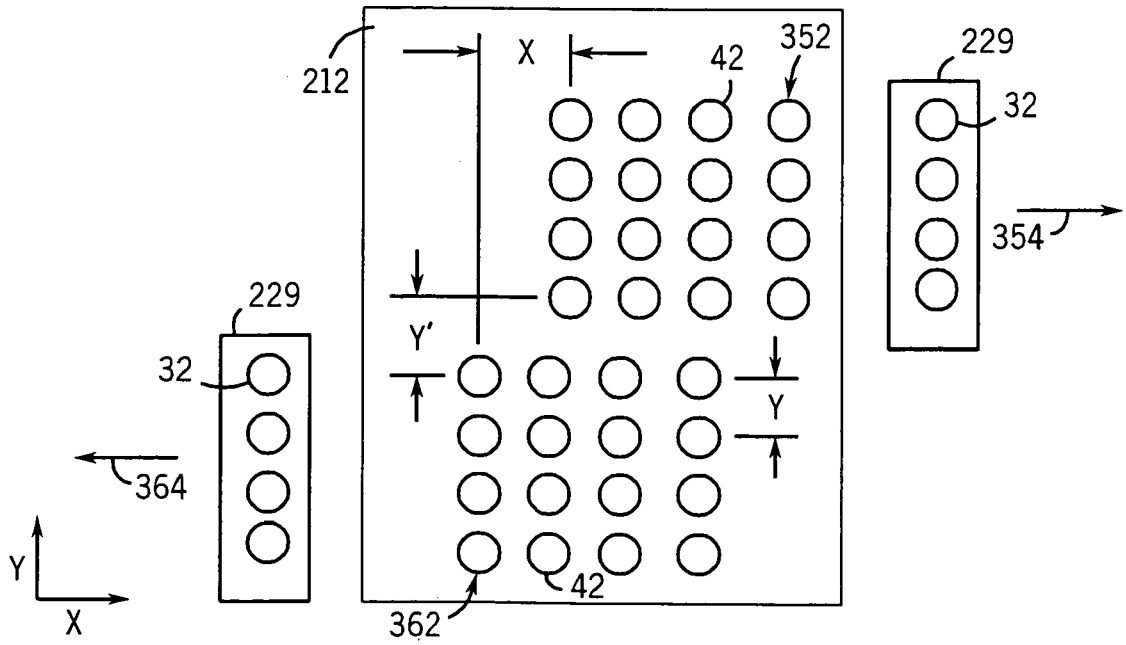
FIG. 12 is a top plan view of a medium having a first pattern of diagnostic marks formed by a printhead moving in a first direction and second pattern of diagnostic marks formed by the printhead moving in a second direction.

FIGS. 10-12 illustrate image-forming device 210, another embodiment of image-forming device 10. Image-forming device 210 is similar to image-forming device 10 except that image-forming device 210 is configured to print or form diagnostic marks 42 and non-diagnostic images 44 using image-forming points 32 of printheads 229 which are also moved relative to medium 212. Like device 10, device 210 analyzes such diagnostic marks to diagnose the functioning of device 10 and to provide notification or correction of any errors.

Device 210 includes media feed 216, carriage 218, carriage drive 220, print cartridges 224, 226, 228, sensor 230, controller 232 and computer readable media 234. Media feed 216 is similar to media feed 16 in that media feed 216 is configured to move medium 212 relative to printheads 229 of print cartridges 224, 226 and 228. In particular, media feed 216 moves medium 212 between print swaths when printheads 229 are not printing. Media feed device 216 comprises one or more mechanisms, such as belts, pulleys, drive rollers and motors, configured to feed and move medium 212. The exact configuration of media feed device 216 may be varied depending upon characteristics of medium 212.

Carriage 218 generally comprises a structure configured to move back and forth across medium 212 along a scan axis 240 while supporting at least one print cartridge. In the particular embodiment illustrated, carriage 230 is configured to support three print cartridges 224, 226 and 228. In other embodiments, carriage 230 may be configured to hold a greater or fewer number of such print cartridges.

Carriage drive 220 is shown schematically and generally comprises an actuator configured to move carriage 230 along scan axis 240 across medium 212 in response to control signals from controller 232.

Print cartridges 224, 226 and 228 generally comprise portable ink or printing material containing units which are removably coupled to carriage 218. Each print cartridge 224, 226 and 228 includes one or more printheads 229 and further includes an entire supply of ink or other printing material being deposited upon medium 212 by printheads 229. In other embodiments, device 210 may alternatively utilize print cartridges or pens wherein ink or other printing material is supplied from a distinct source such as in an off-axis printing system. In such off-axis supply systems, cartridges 224, 226 and 228 may alternatively be permanently coupled to carriage 218.

Sensor 230 comprises a mechanism configured to detect diagnostic marks 42 upon print medium 218. In the particular embodiment illustrated, sensor 230 comprises an optical sensor. Sensor 230 generates electrical signals that are processed by controller 232. In the particular embodiment illustrated, sensor 230 is coupled to carriage 218 and is configured to be moved by carriage drive 220 along scan axis 240 across medium 212. In other embodiments, sensor 230 may be coupled to one or more of print cartridges 224, 226 or 228, may be coupled to carriage 218 or may be movably coupled, may be movably coupled to another structure of device 210 so as to move across or relative to medium 212 or may be stationarily coupled to a frame or other structure, wherein media feed 216 moves medium 212 relative to sensor 230. For purposes of this disclosure, the term "coupled" shall mean the joining of two members directly or indirectly to one another. Such joining may be stationary in nature or movable in nature. Such joining may be achieved with two members or the two members and any additional intermediate members being integrally formed as a single unitary body with one another or with the two members or the two members and any additional intermediate member being attached to one another. Such joining may be permanent in nature or alternatively may be removable or releasable in nature.

Controller 232 is similar to controller 26 except that controller 232 additionally generates control signals which direct the operation of carriage drive 220. Controller 232 generates control signals based upon instructions from computer readable media 234. Computer readable media 234 comprises any form of media containing executable instructions that are readable by a computing device. The instructions contained by media 234 are used by controller 232 to generate control signals to cause the printing of diagnostic marks 42 during a print job in which non-diagnostic images 44 are also being formed upon medium 212. Instructions contained by media 234 are also used by controller 232 to analyze the sensed positioning and spacing of diagnostic marks 42 to diagnose potential problems. In particular embodiments, instructions contained by media 234 also direct controller 232 to generate control signals to provide notification of potential issues or problems and/or to take remedial action by adjusting particular image-forming points 32 of printheads 229 which are used to form images upon medium 212, by adjusting the distance at which medium 212 is moved by media feed 216 relative to printheads 229 or by adjusting the positioning of printheads 229 by carriage drive 220 during subsequent printing of non-diagnostic images 44.

FIGS. 11A-11D schematically illustrates two patterns 252, 262 of diagnostic marks 42 formed using distinct sets of multiple image-forming points 32 of one or more of printheads 229 during multi-pass printing. Diagnostic marks 42 of pattern 252 are schematically indicated on medium 212 with circles while diagnostic marks 42 of pattern 262 are schematically illustrated on medium 212 with squares. Patterns 252 and 262 are sensed by sensor 230 and the information is analyzed by controller 232 under the instruction of media 234 to diagnose printing issues.

In operation as shown by FIG. 11A, controller 232 generates control signals which cause carriage drive 220 to move carriage 218 and printheads 229 (shown in FIG. 10) across medium 212 in at least one direction as indicated by arrows 273. Controller 232 further generates control signals which selectively actuate a first portion 274 of a first set 266 (indicated by circles on printhead 229) of image-forming points 32 of printhead 229 to form pattern 252 of diagnostic marks 42. Thereafter, controller 232 generates control signals which cause media feed 216 to advance medium 212 by a predefined distance in the direction indicated by arrow 264. While marks 42 of patterns 252, 262 are shown to be of different shapes, in many embodiments, these marks are of the same or similar shape.

As shown by FIG. 11B, controller 232 further generates control signals which cause carriage drive 220 to once again move printhead 229 across medium 212 and which also actuates printhead 229 to form pattern 262 of diagnostic marks 42 using a second set 268 (indicated by squares on printhead 229) of image-forming points 32 of printhead 229. As further shown by FIG. 11B, a first portion 276 of the set 268 of image-forming points 32 forms diagnostic marks 42 (indicated with squares) upon medium 212 which fill in the spaces between diagnostic marks 42 previously formed by set 266 of image-forming points 32. A second portion 278 of set 268 of image-forming points 32 populates a new area of medium 212 with diagnostic marks 42. Thereafter, controller 232 generates control signals which cause the media feed 216 to advance medium 212 by a predefined distance in the direction indicated by arrow 270.

As shown by FIG. 11C, controller 232 generates control signals which cause carriage drive 220 to once again move printhead 229 across medium 212 and which also actuates printhead 229 to continue printing pattern 252 of diagnostic marks 42 using the first set 266 of image-forming points 32. As shown by FIG. 11C, first portion 280 of set 266 of image-forming points 32 forms diagnostic marks 42 (indicated by circles) which are interleaved between those diagnostic marks 42 previously formed by portion 278 of set 268 of image-forming points 32 as shown in FIG. 11B (illustrated by squares). A second portion 274 of the set 268 of image-forming points 32 form diagnostic marks 42 (indicated by circles) which populate a new area of medium 212. The general process shown in FIGS. 11B and 11C is repeated during a print job, before, during and after image-forming points 32 are also actuated to form a non-diagnostic image. As shown by FIG. 11D, during the last pass of printhead 229, controller 232 generates control signals which cause carriage drive 220 to move printhead 229 across medium 212 and to also actuate printhead 229 to continue printing pattern 262 of diagnostic marks 42 using portion 276 of set 268 of image-forming points 32 to fill in the spaces between diagnostic marks 42 previously formed by portion 274 of set 266 of image-forming points 32 during the previous pass or swath.

As interleaved patterns 252 and 262 are formed upon medium 212 during each swath of printhead 229 across medium 212, controller 232 generates control signals which further move sensor 230 into a position so as to sense patterns 252 and 262. The location and spacing of marks 42 of patterns 252 and 262 (represented by electrical signals) are transmitted by sensor 230 to controller 232. Controller 232 analyzes the location and spacing of marks 42 to determine an x-axis offset and a y-axis offset between patterns 252 and 262. The x-axis offset distance and the y-axis offset distance may be the result of medium 212 being skewed as it is being moved relative to printheads 229 by media feed 216. The x-axis offset is equal to a difference between the sensed actual position of marks 42 of pattern 262 and the expected or nominal position of marks 42 of pattern 262 as compared to marks 42 of pattern 252. For example, in the particular embodiment shown in FIG. 11D, the nominal positioning of marks 42 of pattern 262 would have resulted in marks 42 of pattern 262 extending in the same x-axis position as corresponding marks 42 of pattern 252. However, as shown in FIG. 11D, marks 42 of pattern 262 are offset from marks 42 of pattern 252 by a distance X. Controller 232 utilizes this determined x-axis offset X to adjust the timing at which the image-forming points of the particular printheads 229 are actuated to compensate for the x-axis offset.

The y-axis offset is equal to the difference between the nominal or nominal location of marks 42 of pattern 262 relative to marks 42 of pattern 252 and the actual location of marks 42 of pattern 262 relative to marks 42 of pattern 252. In the particular example shown in FIGS. 11D and 11E, controller 232 generates control signals to cause media feed 216 to advance medium 212 by a distance such that marks 42 of pattern 252 formed by set 266 are spaced from corresponding marks 42 of pattern 262 formed by set 268 by a distance Y'. However, as shown by FIG. 11D, marks 42 of patterns 262 are actually spaced from marks 42 of pattern 252 by a distance Y". As a result, the y-axis offset is equal to Y"−Y'.

Using this determined y-axis offset distance, controller 232 generates control signals to compensate for this y-axis offset. In one embodiment, controller 232 generates control signals which adjust the distance at which media feed 216 moves medium 212 relative to printheads 229 during subsequent printing of non-diagnostic images 44.

FIG. 12 schematically illustrates a method for using diagnostic marks 42 formed upon the same surface as non-diagnostic images 44 (shown in FIG. 10) to diagnose errors of image-forming device 210. In particular, FIG. 12 schematically illustrates the forming of a first pattern 352 using image-forming points 32 of printhead 229 as printhead 229 is moved in the positive x-axis direction by carriage drive 220 and the forming of second pattern 362 of diagnostic marks 42 by image-forming points 32 of printhead 229 as carriage drive 220 moves printhead 229 in the negative x-axis direction. Between the printing of patterns 352 and 362, media feed 216 (shown in FIG. 10) advances medium 212 in the negative y-axis direction by a predetermined distance. In the particular example shown, image-forming points 32 are actuated so as to form diagnostic marks 42 of pattern 362 in alignment with corresponding marks 42 of pattern 352. However, as shown by FIG. 12, patterns 352 and 362 are actually spaced from one another by a y-axis distance Y' rather than a Y. In lieu of marks 42 of pattern 352 being in alignment with marks 42 of pattern 362, marks 42 of pattern 352 are offset from corresponding marks 42 of pattern 362 in the x-axis by a distance X. The actual location and spacing of marks 42 of patterns 352 and 362 are sensed by sensor 230 and are transmitted to controller 232. Controller 232 calculates the x-axis offset X. Controller 232 further calculates the y-axis offset Y'−Y.

To compensate for the x-axis offset distance X, controller 232 generates control signals which either cause carriage drive 220 to adjust its positioning of printhead 229 relative to medium 212 during the subsequent printing of non-diagnostic images 44 as printhead 229 is moved in the direction indicated by arrow 364. In addition, or alternatively, controller 232 may also generate control signals such that an alternative set of image-forming points 32, offset in the negative x-axis direction from those image-forming points 32 normally utilized when printhead 229 is moved in the positive x-axis direction, are used during the subsequent printing of non-diagnostic images 44.

To compensate for the y-axis offset Y'−Y, controller 232 may generate control signals causing media feed 216 to adjust the positioning of medium 212 during the subsequent printing of non-diagnostic images 44.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A method for diagnosing an image-forming device, the method comprising:

forming a non-diagnostic image on a surface with the image-forming device;

forming diagnostic marks on the surface using distinct image-forming points of the image-forming device; and sensing the diagnostic marks, wherein the diagnostic marks are formed in a pattern, wherein the pattern follows a formula C=(s+1)*(MOD (r, m)+m*n); where C=the column in which a diagnostic mark is to be formed for a particular corresponding row r of at least one image-forming point, m=the number of unmarked rows between marks in each column plus one, n=the nth diagnostic mark in a row for a particular image-forming point, where n begins with 0, and s=a designated spacing between columns containing the diagnostic marks.

2. The method of claim 1, wherein an order of the columns is randomized.

3. The method of claim 1, wherein the column spacing is varied.

4. The method of claim 1, wherein the column spacing is uniform.

5. The method of claim 1, further comprising:

determining an offset compensation value from spacing between sensed diagnostic marks; and adjusting time at which the image-forming points form images based upon the offset compensation value.

6. The method of claim 1, further comprising:

determining an offset compensation value from spacing between sensed diagnostic marks; and using a subset of the image-forming points based upon the offset compensation value.

7. The method of claim 1, wherein the diagnostic marks are substantially imperceptible to a human eye.

8. The method of claim 1, wherein the diagnostic marks form a background pattern that does not substantially interfere with the readability or viewing of the non-diagnostic image.

9. The method of claim 1, wherein the diagnostic marks have a constant and predefined frequency.

10. The method of claim 1, wherein the image-forming points are stationary during the forming of diagnostic marks on the surface.

11. The method of claim 1, wherein the image-forming device includes a total number of image-forming points and wherein the total number of image-forming points are used to form the diagnostic marks.

12. The method of claim 1, wherein sensing includes detecting missing diagnostic marks to identify malfunctioning image-forming points.

13. The method of claim 1, wherein the surface is curved, and wherein a first portion of the surface has a first curvature and wherein a second portion of the surface has a second distinct curvature.

14. The method of claim 1, wherein the image-forming points comprise fluid-ejecting nozzles.

15. The method of claim 1, wherein each diagnostic mark has a surface area of no greater than 200 microns.

16. The method of claim 1, wherein each diagnostic mark is formed by a single actuation of an image-forming point.

17. The method of claim 1, wherein sensing the diagnostic marks includes detecting spacing between the diagnostic marks.

18. The method of claim 1, wherein sensing includes detecting spacing between the diagnostic marks in a first direction and detecting spacing between the diagnostic marks in a second direction substantially perpendicular to the first direction.

19. The method of claim 18, including moving the surface relative to the image-forming points in the first direction.

20. The method of claim 18, including moving the image-forming points relative to the surface in the first direction while forming the diagnostic marks.

21. The method of claim 20, including moving the image-forming points relative to the surface in the second direction opposite to the first direction while forming the diagnostic marks.

22. The method of claim 1, wherein the diagnostic marks are formed using image-forming points of a first printhead and a second printhead.

23. The method of claim 22, wherein sensing includes detecting spacing between diagnostic marks formed by the first printhead and diagnostic marks formed by the second printhead.

* * * * *